US010252433B2

(12) United States Patent
Gers-Barlag et al.

(10) Patent No.: US 10,252,433 B2
(45) Date of Patent: Apr. 9, 2019

(54) RAZOR WITH A RESILIENT HOLDER

(71) Applicant: BEIERSDORF AG, Hamburg (DE)

(72) Inventors: Heinrich Gers-Barlag, Kummerfeld (DE); Yvonne Neumann, Hamburg (DE)

(73) Assignee: BEIERSDORF AG, Hamburg (DE)

( * ) Notice: Subject to any disclaimer, the term of this patent is extended or adjusted under 35 U.S.C. 154(b) by 163 days.

(21) Appl. No.: 14/905,044

(22) PCT Filed: Jul. 11, 2014

(86) PCT No.: PCT/EP2014/064941

§ 371 (c)(1),
(2) Date: Jan. 14, 2016

(87) PCT Pub. No.: WO2015/007647

PCT Pub. Date: Jan. 22, 2015

(65) Prior Publication Data

US 2016/0151925 A1 Jun. 2, 2016

(30) Foreign Application Priority Data

Jul. 16, 2013 (DE) ..... 10 2013 213 874

(51) Int. Cl.

| | |
|---|---|
| ***B26B 21/52*** | (2006.01) |
| ***B26B 21/44*** | (2006.01) |
| ***B26B 21/22*** | (2006.01) |
| ***B26B 21/40*** | (2006.01) |

(52) U.S. Cl.

CPC ..... *B26B 21/522* (2013.01); *B26B 21/225* (2013.01); *B26B 21/4068* (2013.01); *B26B 21/443* (2013.01); *B26B 21/52* (2013.01)

(58) Field of Classification Search

CPC . B26B 21/522; B26B 21/225; B26B 21/4068; B26B 21/443; B26B 21/52

See application file for complete search history.

(56) References Cited

U.S. PATENT DOCUMENTS

| | | | |
|---|---|---|---|
| 4,170,821 | A | 10/1979 | Booth |
| 5,678,316 | A | 10/1997 | Althaus et al. |
| 8,387,259 | B2 | 3/2013 | Starr |

(Continued)

FOREIGN PATENT DOCUMENTS

| | | | |
|---|---|---|---|
| DE | 208426 | A | 12/1907 |
| DE | 2851457 | A1 | 6/1979 |

(Continued)

*Primary Examiner* — Omar Flores Sanchez

(74) *Attorney, Agent, or Firm* — Abel Law Group, LLP

(57) ABSTRACT

The invention relates to a razor and a method for producing a razor. To make available an improved razor, a razor (1) has a handle (10) with a lower face (12) for placing on the skin of a user, and with an upper face (11) which lies opposite the lower face and is placed in the hand of the user, and a blade head (20) with at least one razor blade (21) at a head end of the lower face, wherein the lower face and upper face are fixed to each other at a respective handle end (15) and are designed to be spaced apart from each other at a respective head end (16), and wherein the lower face, in at least one subregion (34) between the handle end and the head end, is advantageously more elastic than the opposite subregion of the upper face.

14 Claims, 10 Drawing Sheets

(56) References Cited

U.S. PATENT DOCUMENTS

| | | | | |
|---|---|---|---|---|
| 2006/0070239 | A1* | 4/2006 | Ries | B26B 21/40 30/34.2 |
| 2011/0041342 | A1 | 2/2011 | Starr | |
| 2013/0081289 | A1 | 4/2013 | Wain | |
| 2016/0158949 | A1* | 6/2016 | Eagleton | B26B 21/443 30/34.2 |
| 2017/0225344 | A1* | 8/2017 | Lessmann | B26B 21/443 |
| 2017/0312928 | A1* | 11/2017 | Greene | B26B 21/527 |
| 2017/0334081 | A1* | 11/2017 | Dryfhout | A45D 27/04 |

FOREIGN PATENT DOCUMENTS

| | | | |
|---|---|---|---|
| DE | 9304140 | U1 | 7/1994 |
| DE | 29503575 | U | 4/1995 |
| DE | 69611838 | T2 | 9/2001 |
| DE | 202011107715 | U1 | 1/2012 |
| GB | 2458520 | A | 9/2009 |
| WO | 2007039737 | A1 | 4/2007 |
| WO | 2012120499 | A1 | 9/2012 |

* cited by examiner

RAZOR WITH A RESILIENT HOLDER

BACKGROUND OF THE INVENTION

1. Field of the Invention

The present invention relates to a razor and a method for producing a razor.

In the sense of the present invention, shaving is understood as meaning cutting the hairs on the skin to just above the uppermost layer of skin with at least one blade. This does not involve removing the hair, just shortening it.

2. Discussion of Background Information

Known razors comprise an elongate handle part, which is connected to a blade head. During use as intended, the handle part lies in the hand of the user, in order to allow the blade head to glide over the user's skin.

Such razors are usually used for wet shaving, but it is also possible that a razor in the sense of the present application also has a power supply (for example a battery or rechargeable battery), which causes a vibration in the blade head in order to bring about a massaging effect and/or increase the closeness of the shave.

These razors are available as disposable articles, with permanently installed or exchangeable blade heads and a wide variety of blade head variations with different numbers of razor blades.

DE2851457A1 describes a razor cartridge with a blade seat, a razor blade and a cap, an integral solid, water-soluble shaving aid being provided.

DE9304140U1 describes a wet razor with a handle, which has at the front end a razor head, on which a razor blade unit is arranged, the handle being curved in the direction pointing toward the surface to be shaved in the functional position.

DE202011107715U1 describes a shaving system with two blade heads, which are arranged oppositely in the pulling and pushing directions of the shaving system.

DE69611838T2 describes a disposable razor including a handle, a blade unit and an elastic double-curved connection between the handle and the blade unit.

DE208426A describes a safety razor, the handle and protective combs of which consist of one piece of bent metal sheet.

US2013081289A1 describes a handle biased by a cartridge and comprising an elongate body, a head at a first end of the body, a pair of integral elastic arms, which extend outward from the head to a distal end, and a slot between the head and each arm.

DE 29503575 discloses a razor of which the handle part represents a leaf spring. On account of the spring action of the leaf spring, the pressing force during shaving is reduced, and as a result the risk of injury is reduced.

One problem with this is that the user has to use the leaf spring at the same time as a handle, and consequently the desired reduction in the pressing force cannot be achieved.

SUMMARY OF THE INVENTION

An object of the invention is to provide an improved razor.

In one aspect, the invention relates to a razor with a handle having a lower face for resting on the skin of a user and an upper face, opposite from the lower face, for lying in the hand of the user, and with a blade head having at least one razor blade at a head end of the lower face, the lower face and the upper face being fixed to one another at a respective handle end and being designed to be spaced apart from one another at a respective head end, and the lower face advantageously being more elastic in at least a subregion between the handle end and the head end than the opposite subregion of the upper face.

The invention is based on the idea that a razor of which the blade head yields to pressure or absorbs when there is excessive pressure on the skin of the user is more satisfying and can be used reliably for shaving. As a result of the flexibility of the head end of the lower face in comparison with the relatively rigid upper face of the handle, this pressure can be absorbed. The blade head thus adapts itself particularly flexibly to possible unevennesses or curvatures of the skin and thus makes particularly safe shaving possible. The blade head glides smoothly over the skin with relatively uniform pressure for consistent shaving results, which makes shaving particularly satisfying for the user. This enables the user to have a close, satisfying shave without expending great force.

The lower face and the upper face are preferably formed as layers. The upper face and the lower face are firmly connected to one another at their handle ends, whereas their head ends are freely movable with respect to one another. The head end of the lower face is designed to spring with respect to the head end of the upper face, and consequently absorb pressure on the surface of the user's skin during use as intended, and thus reduce the risk of injury.

In the unused state of the razor, the lower face is relieved and the head ends of the lower face and the upper face are spaced apart from one another. In the state of use as intended, the head end of the lower face, on which the blade head with the razor blade(s) is arranged, is placed onto the user's skin and drawn over it, it being possible for a pressure to build up on the head end of the lower face either due to active exertion of pressure by the user or due to unevennesses of the skin. This pressure is intercepted or cushioned by the lower face being deflected in the direction of the head end of the upper face in the elastic subregion (also referred to as the "flex region" or "flex point"). Thus, a substantially constant pressure of the blade head on the skin to be shaved is advantageously made possible, whereby the shaving becomes uniform, satisfying and safe for the user.

In the present case, an elastic "subregion" may mean a certain portion on the lower face. However, it is also within the sense of the invention that the subregion extends over the entire length of the lower face, and consequently corresponds to the entire lower face. It is also possible that the entire lower part (or only the head part thereof) is elastic and additionally has a still more elastic subregion. All that is important is that the head part of the lower face, which is designed for receiving the blade head, is designed movably in relation to the head end of the upper face.

The lower part is preferably designed as a leaf spring.

The fact that the upper part acts as a handle means that the resilient action of the lower part, in particular of the leaf spring, is not impaired.

In particularly preferred embodiments, the razor according to the invention has a combination of a fixed upper face and a flexible lower face, which adapt themselves to different areas of the skin and protect them from injuries in the form of cuts. The form of the razor is preferably substantially flat and has a double-layer structure consisting of a lower face and an upper face. The two layers (lower face and upper face) consist at least partially of different materials with differing elasticity. The stronger, preferably impact-resistant material (for example ABS (acrylonitrile butadiene styrene)) lies on the upper side of the razor, which describes the razor in its ergonomic form, preferably bent slightly concavely or convexly along the longitudinal axis of the razor. The lower side of the razor consists for example of a nonslip material (for example TPE (thermoplastic elastomer)) and may optionally include nonslip grip elements (rough surfaces, grooving).

The lower face is only partly connected to the upper face. The construction of the razor is defined by at least one flex point, preferably multiple different flex points, which define the degree of flexibility (potential deflection) of the head end. This includes different levels of flexibility of the razor, which are described by the material mix and the differing position of the flex points.

Moreover, the blade head may have different angles in relation to the razor and, by comprising elastic material, likewise contribute to the flexibility of the razor. For skincare, the blade head may include a balsam strip (care strip) with emulsions and nourishing oils.

According to one aspect of the present invention, the razor is therefore a two-layer system, which as a result of its material mix and specifically elastic flex regions improves the adaptation of the blade head to regions of the user's body that are difficult to access. The individual adaptation of the razor to different, sensitive portions of the skin is ensured by multiple levels of flexibility and preferably different blade head angles.

It is thus advantageously possible to achieve a combination of fixed and flexible shaving movements that adapt themselves to different areas of the skin to be shaved. The razor preferably has a flat form with a double-layer structure (two different materials, fixed and flexible), which makes different flexing levels and blade head angles possible. The handle is preferably ergonomically formed by concave and convex curvatures and grip regions and has a nonslip lower face. The blade head may include balsam strips of various types. Various/multiple flexing points on the lower face, in particular the head end of the lower face, improve the adaptation of the razor to the areas of the skin to be shaved.

Particularly sensitive shaving, in which only little pressure on the razor is necessary and any superfluous pressure is intercepted by the elastic lower face, is made possible according to the invention. The blade head arranged at the resilient head end of the lower face adapts itself "as if of its own accord" to the surface of the user's skin. The blades thus advantageously lie closer and more directly on the skin and altogether a smaller pressure on the razor is required for shaving. The flexibility and smoothness of the shave is ensured according to the invention by lower pressure on the razor and the razor blades that are flexible with respect to the upper face of the handle. The shave is thus ergonomically satisfying and reduces the risk of injuries in the form of cuts.

In one embodiment, the head ends of the lower face and the upper face overlap at least partially. The upper face preferably forms the stop for maximum deflection of the lower face. Thus, the user can easily establish that the maximum pressure on the skin, and consequently the lower face and the razor blades of the razor, has been achieved, when the lower face comes to lie completely against the upper face, and can reduce the pressure correspondingly.

In one embodiment, the razor also has a slide element for varying a possible deflection of the head end. The slide element is preferably a slide ring, which is arranged around the lower face and the upper face and is designed to be displaced between the head ends and the handle ends. The flexibility (possible curvature under deflection) of the head end or the lower part can thus advantageously be varied. Thus, the razor can for example be prepared for transport by the slide ring being pushed onto the head end, so that the lower part and the upper part lie against one another, in order to be able to transport the razor as compactly as possible. In such a position, the ring can also cover over the blade head and thus serve as a cap for the blades and protect them during transport or while they are being kept in the user's bathroom (for example shower). Depending on the position of the slide ring along the longitudinal axis of the razor, a greater or smaller deflection of the head end of the lower face is made possible. Thus, the user is advantageously offered a particularly easy possible way of adapting the razor particularly flexibly to his/her own needs.

In one embodiment, the upper face consists of a material with less elasticity than the lower face. The upper face is preferably formed from a material that is rigid in relation to the material of the lower face. In embodiments, the upper face and/or the lower face may be formed in one piece from a respective material. It may, however, also be preferred that the upper face and/or the lower face respectively comprise different materials. It may also be preferred that the upper face and the lower face consist of the same material and only the flexible subregion of the lower face comprises a different, more elastic material. It may also be preferred that the handle ends of the upper face and the lower face are formed in one piece, and the remaining part of the lower face is fastened movably to the handle end.

In one embodiment, the handle is formed concavely or convexly along the longitudinal axis of the razor. It may also be preferred that the handle is described in a slightly bent form and consists of strong, impact-resistant material (for example ABS (acrylonitrile butadiene styrene)). A convexly curved handle can be used ergonomically particularly satisfyingly and also reliably for shaving, since the handle adapted to the concavely curved palm of the hand makes particularly ergonomic handling possible. On the other hand, a convex form of handle may be particularly advantageous to allow pressure to be applied sensitively to the region of the skin to be shaved.

In one embodiment, the outline of the lower face corresponds to the outline of the upper face. The lower face and the upper face thus advantageously have the same form and they can for example be brought completely into contact with one another by a slide ring at the head end, in order thus to give the razor a particularly compact form, which is advantageous for transport. The respective head end is preferably wider than the respective handle end, which is advantageous to allow a wide blade head to be received and at the same time to lie satisfyingly in the user's hand.

In one embodiment, the lower face has along the longitudinal axis of the razor a multiplicity of subregions with different elasticities. The difference in the elasticities may be achieved for example by a suitable choice of material or by the thickness of the material layer. The subregions may be produced from the same material, their width and/or thickness and/or length varied or comprise different materials. It may be preferred that those subregions that lie closer to the head end are more elastic than those subregions that lie closer to the handle end (or vice versa). It may also be preferred that those subregions that lie substantially midway between the head end and the handle end are more elastic than those subregions that lie closer to the ends (or vice versa). It is thus advantageously made possible that unevennesses of the user's skin can be replicated particularly well by suitable choice of a razor with appropriate elasticity behavior in the subregions.

In one embodiment, the blade head is arranged at the head end of the lower face as an extension of the lower face or at an obtuse angle to the lower face. If the blade head is arranged as an extension of the lower face, particularly smooth gliding of the blades lying flat against the lower face over the skin can be achieved, with the pressure being absorbed by the lower face. If the blade head has an obtuse angle in relation to the lower face (the blade head is therefore curved in the direction of the upper face), areas of the skin that are particularly difficult to access can be reached. In preferred embodiments, the subregion that forms the fastening region of the blade head is elastic, so that the arrangement of the blade head at the head end of the lower face as an extension of the lower face or at an obtuse angle to the lower face the obtuse angle varies during use as intended. Thus, the yielding compliance of the blade head as a result of a corresponding deflection of the head end is further increased. It may also be preferred that blade heads with different angles (which are adapted to different regions of the surface of the user's skin) can be arranged on the razor.

In one embodiment, the blade head has a special blade and/or a balsam strip.

The razor may advantageously be supplemented by one or more special blades. The blade head therefore preferably has different types of blade, which makes an improved, more precise shave possible in different regions of the user's skin. Thus, for example, the razor blade(s) of the blade head may be suitable for shaving over a large area, which may be refined by the use of one or more smaller special blade(s). Depending on requirements, different blade heads with different special blades may be arranged on the razor, whereby the applicational flexibility is advantageously increased.

A balsam strip in the sense of the present application may be a strip that comprises for example a shaving soap, a moisturiser, a soothing skincare product, an oil or the like. It is preferred to arrange the balsam strip on the blade head adjacent and parallel to the at least one razor blade and/or the at least one special razor blade. This advantageously achieves the effect that the skin is not only shaved but also treated and cared for by the balsam strip.

A particularly smooth and close shave and skincare can be advantageously made possible by the use of one or more special blade(s) and/or balsam strip(s) on the blade head. With just one or a few movements of the razor over the region of the skin to be shaved, it is shaved closely and smoothly and thereby cared for at the same time.

Depending on use for different regions of the user's body, blade heads with a differing design and arrangement of the blade head may be arranged at the head end.

In one embodiment, the handle has grip elements for the nonslip holding of the handle by the user. In one embodiment, the handle has at least one grip element for nonslip holding by the user. In one embodiment, the upper face and/or the lower face of the handle has/have grip elements for the nonslip holding of the handle by the user. The handling of the razor and its hold in the hand of the user can be advantageously improved by grip elements, such as for example roughened regions, a grooving, an adhesive surface, regions of nonslip material, being provided on the upper face and/or the lower face and/or concave/convex curvatures being provided on the handle. Thus, the handle advantageously lies particularly well in the hand, particularly safe handling of the razor is made possible and "slipping away" of the razor is prevented.

In one embodiment, the lower face has a recess, in which the blade head is arranged. The connection between the blade head and the lower face preferably takes place by way of a simple click mechanism (recess on the lower face and projection on the blade head engaging therein or recess on the blade head and projection on the lower face engaging therein), which makes changing of the blade head possible particularly easily. The blade head is preferably detachably connected to the lower face by means of the recess. In one embodiment, the blade head is fixed in the recess by means of retaining elements, for example locked by means of latching elements. Bringing about the fixing of the blade head just by means of a form fit or simple retaining elements in the recess advantageously allows a flat lower face of the razor to be provided, which improves the handling and makes a satisfying shave possible.

In one embodiment, the blade head has a multiplicity of razor blade(s). The razor blade(s) is/are preferably arranged substantially at right angles to the longitudinal axis of the razor. The razor blade(s) is/are arranged on a lower face, which during use of the razor as intended glides over the user's skin in order to carry out the shaving. The arrangement according to the invention of a razor blade/razor blades on the resilient lower face makes a particularly smooth and close shave possible, since the resilient lower face adapts itself particularly pliably to the unevennesses of the surface of the skin.

On account of its flexible possibilities for use, the razor according to the invention is advantageously suitable for shaving part of or the whole body, and in particular for shaving under a shower.

In a further aspect, the invention relates to a method for producing a razor of the present invention, with the steps of: providing a handle having a lower face for resting on the skin of a user and an upper face, opposite from the lower face, for lying in the hand of the user, providing a blade head having at least one razor blade on the lower face, and fixing the lower face and the upper face to one another at a respective handle end, a respective head end of the lower face and the upper face being designed to be spaced apart from one another, the lower face being more elastic in at least a subregion between the handle end and the head end than the opposite subregion of the upper face.

BRIEF DESCRIPTION OF THE DRAWINGS

The embodiments described above may be combined with one another and with the aspects described above as desired in order to achieve advantages according to the invention. Preferred combinations of embodiments are described below by way of example, while

FIGS. 1*a* and 1*c* show a razor 1 from above, and FIGS. 1*b* and 1*d* show it from below.

DETAILED DESCRIPTION OF EMBODIMENTS OF THE INVENTION

Figure 1A:
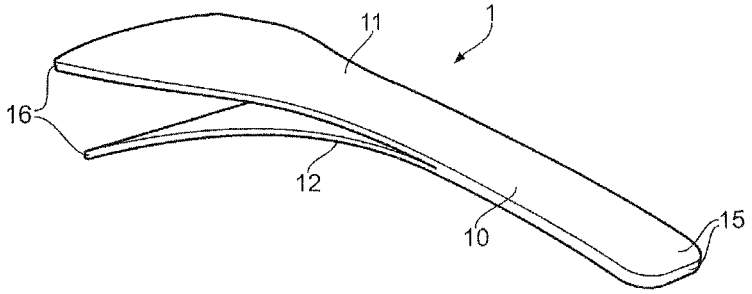
FIGS. 1*a* to 1*d* show an embodiment of a razor according to the invention.
Figure 1B:
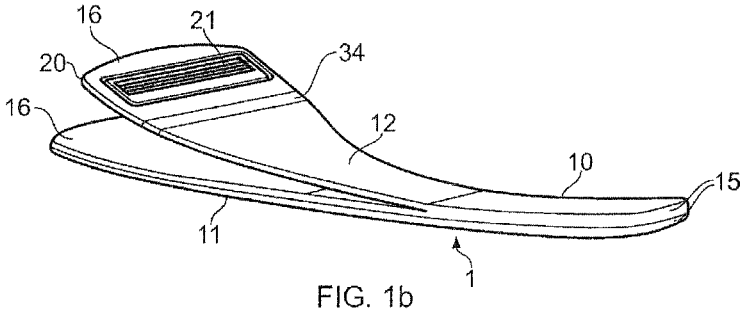
Figures 1C, 1D:
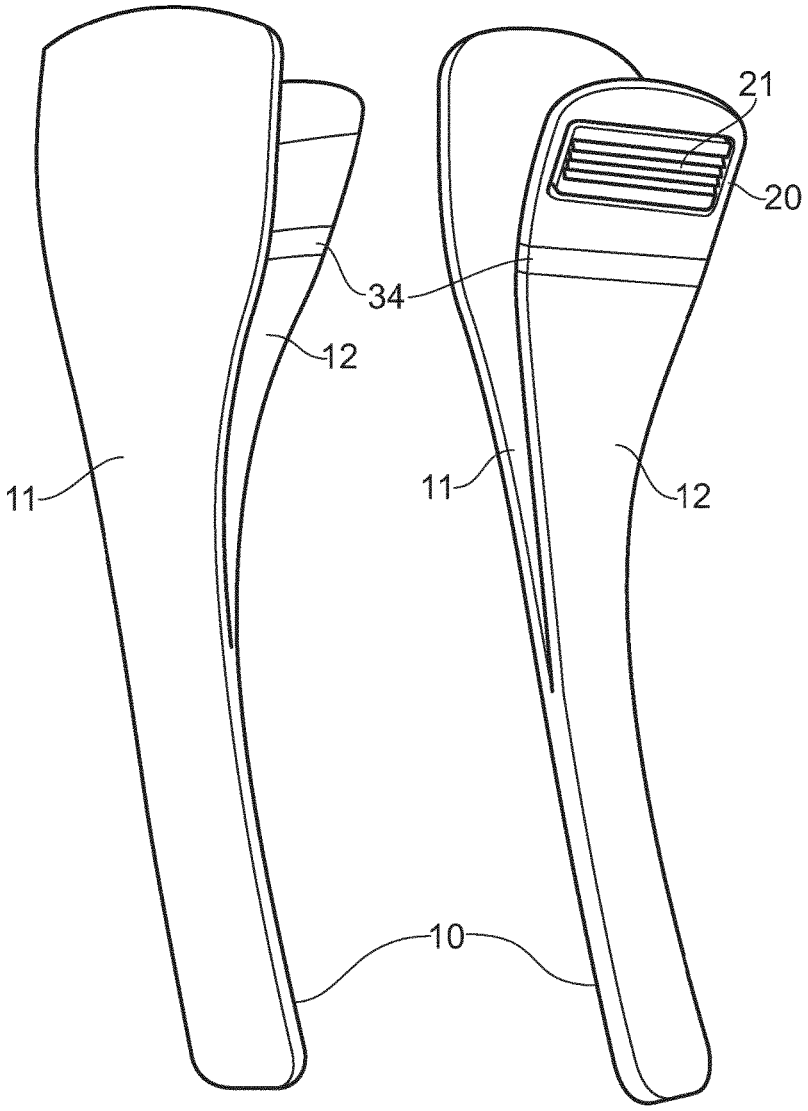

The razor 1 has a convexly formed handle 10 having a lower face 12 for resting on the skin of a user and an upper face 11, opposite from the lower face 12, for lying in the hand of the user, and has a blade head 20 at a head end 16 of the lower face 12. The head ends 16 of the lower face 11 and the upper face 12 overlap completely in the plan view and correspond to one another in their outlines. The head end 16 has as an extension of the lower face 12 the blade head 20, which is equipped with at least one razor blade 21. In the embodiments shown in the figures, the blade head 20 has a multiplicity of razor blades 21. The other end respectively of the lower face 12 and of the upper face 11 is the handle end 15, at which the lower face 12 and the upper face 11 are connected to one another. The handle 10 may have grip elements (not represented), which make nonslip holding of the handle by the user possible.

Figure 2:
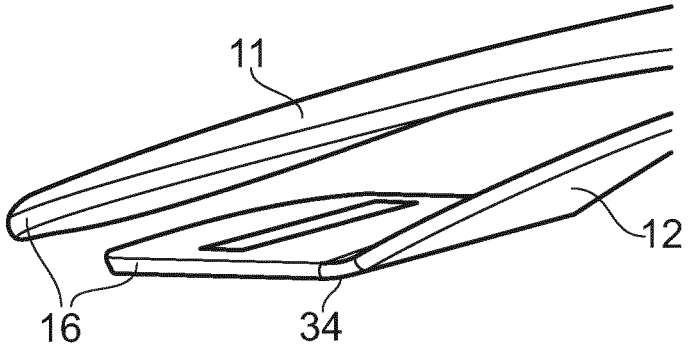
FIG. 2 shows a view of a detail of the head ends of the embodiment of FIG. 1.

Between the head end 16 and the handle end 15 of the lower face 12 there preferably lies an elastic subregion 34, which makes a deflection ("swinging away") of the head end 16 with the blade head 20 possible when a certain pressure on this head end 16 is exceeded, which is illustrated in FIG. 2. FIG. 2 illustrates how the head end 16 of the lower face 12 is deflected at the elastic subregion 34 during use of the razor 1 as intended.

Instead of or in addition to the elastic subregion, the blade head 20 is similarly detachably fastened to the lower face in order to make an easy change of the blade head possible.

Figure 3:
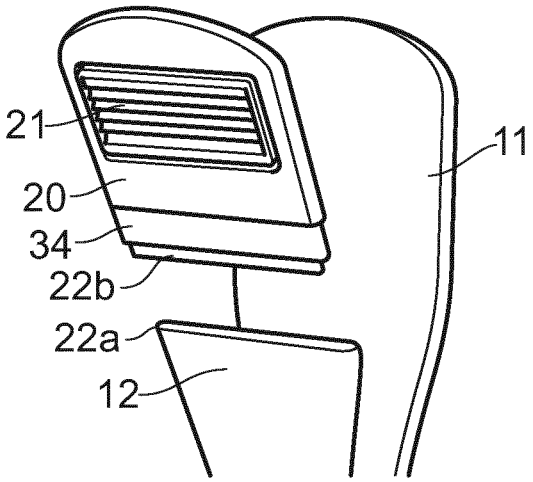
FIG. 3 shows the detachability of the blade head from the head end of the embodiment of FIG. 1.

FIG. 3 illustrates the procedure for a preferred change of the blade head. The blade head 20 is arranged in a recess 22*a*, which is located on the lower face 12. The blade head 20 is locked in the recess 22*a* by means of retaining elements (projections) 22*b* and can be detached from them in order to insert a new blade head 20, for example when the razor blades 21 have become blunt or a blade head 20 with different kinds of razor blades 21, special blades (not represented) or balsam strips 24, 25 is to be used.

The razor 1 is a combination of a fixed element (upper face) 11 and a flexible element (lower face) 12, which can adapt themselves to different regions of the skin to be shaved and protect them from injuries in the form of cuts. The form of the razor 1 is substantially flat and described by a double-layer structure comprising the lower face 12 and the upper face 11. The two layers 11, 12 ideally consist of two different materials, with differing elasticity. A strong, impact-resistant material (for example ABS (acrylonitrile butadiene styrene)) lies on the upper face 11 of the razor 1, which describes the razor 1 in its ergonomic, slightly convexly bent form. The lower face 12 of the razor 1 consists of nonslip material (for example TPE (thermoplastic elastomer)) and may optionally include nonslip grip elements (rough surfaces, grooving).

The lower face 12 is only partly connected to the upper face 11. The construction of the razor 1 is defined by different flex points 34 (subregions), which define the degree of flexibility of the head end 16. This includes different levels of flexibility of the razor 1, which are described by the material mix and the differing position of the flex points 34. Moreover, the blade head 20 may have different angles in relation to the razor 1 and, by comprising elastic material, likewise contribute to the flexibility of the razor 1. For skincare, the razor head 20 may include a care strip 24, 25 (balsam strip) with emulsions and nourishing oils.

The razor 1 is therefore a two-layer (lower face 12 and upper face 11) system, which as a result of its material mix and specifically elastic zones 34 (subregions) improves the adaptation of the blade head 20 to regions of the body that are difficult to access. The individual adaptation of the razor to different, sensitive portions of the skin is ensured by multiple levels of flexibility and different blade head angles.

FIGS. 4 to 7 illustrate further embodiments of the razor 1. To the extent to which the features of the further embodiments coincide with those of the embodiments previously described, reference is made to the features described above.

Figures 4A, 4B:
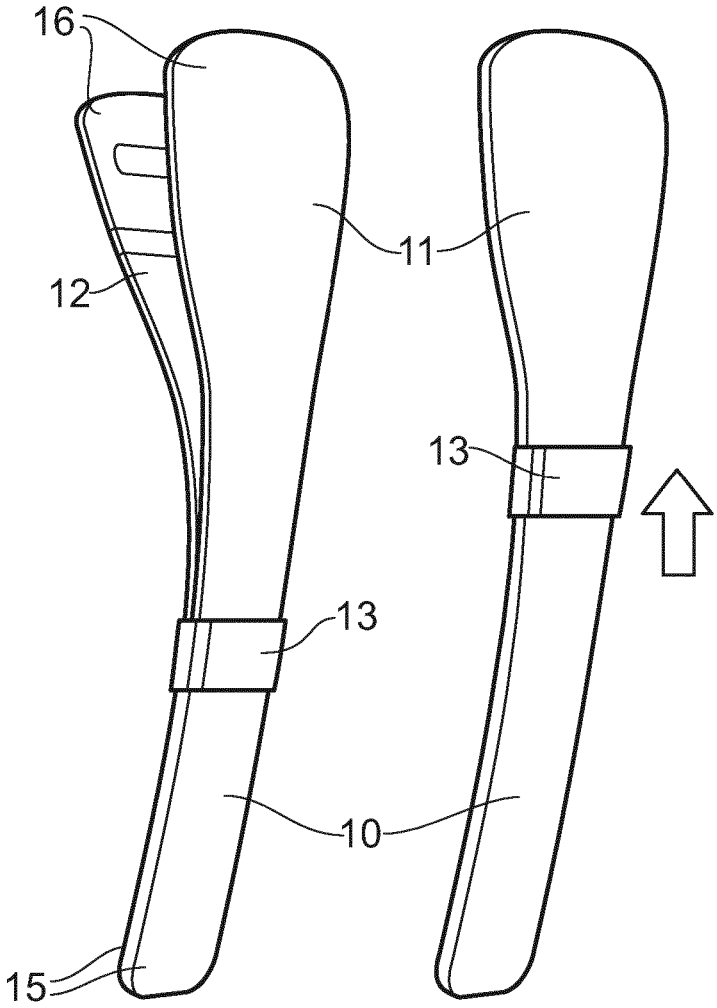
FIGS. 4*a* and 4*b* show a further embodiment of a razor according to the invention.

FIGS. 4*a* and 4*b* show a razor 1 from above, on which an additionally arranged slide ring 13 changes the possible deflection of the lower face 12. In FIG. 4*a* it is shown that the slide ring 13 is arranged relatively close to the handle end 15, so that the slide ring 13 scarcely influences the deflection of the lower face 12 at all. In FIG. 4*b*, the slide ring 13 has been displaced in the direction of the head end 16 and thus draws the lower face 12 to the upper face 11. In FIG. 4*b*, the state in which the lower face 12 lies completely against the upper face 11 is shown. In such a state, the razor 1 can for example be transported particularly well.

If the slide ring 13 is arranged between the two extreme positions that are represented in FIGS. 4*a* and 4*b*, it varies the possible deflection of the head end 16 of the lower face 12. If, for example, the slide ring 13 is arranged precisely between the positions of FIGS. 4*a* and 4*b*, the lower face 12 is biased halfway in the direction of the upper face 112, so that the head end 16 can only perform a deflection that is half as great as in the state shown in FIG. 4*a*.

Furthermore, the slide ring 13 may be designed in such a way that it encloses both the upper face and the lower face. As a result, slipping of the ring 13 toward in the handle end 15 is avoided. Furthermore, this web of the ring 13 between the upper part and the lower part makes further opening up of the lower part from the upper part possible (when the ring 13 is displaced more toward the handle end 15) (not represented).

Figure 5A:
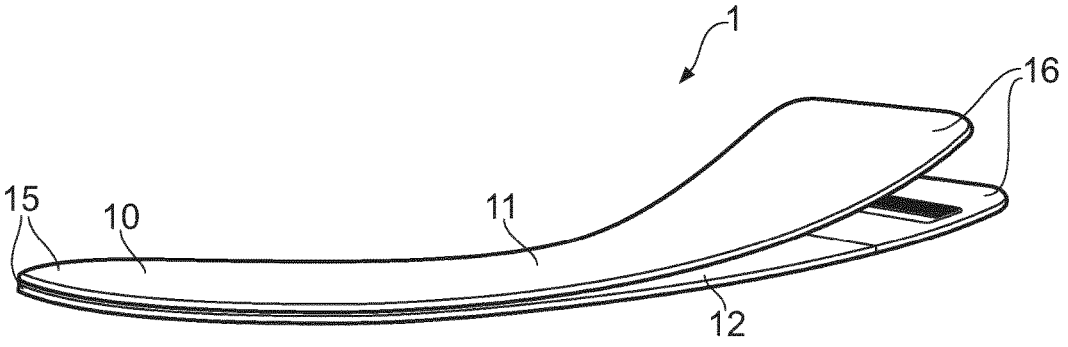
FIGS. 5*a* to 5*d* show a further embodiment of a razor according to the invention.
Figure 5B:
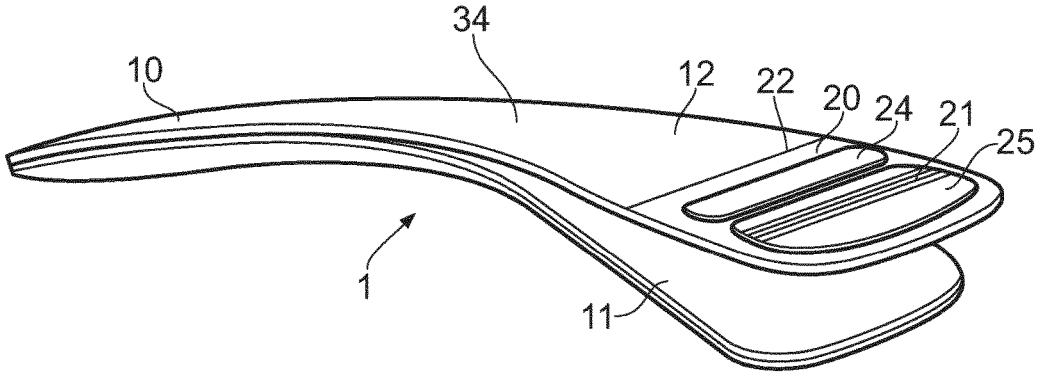
Figures 5C, 5D:
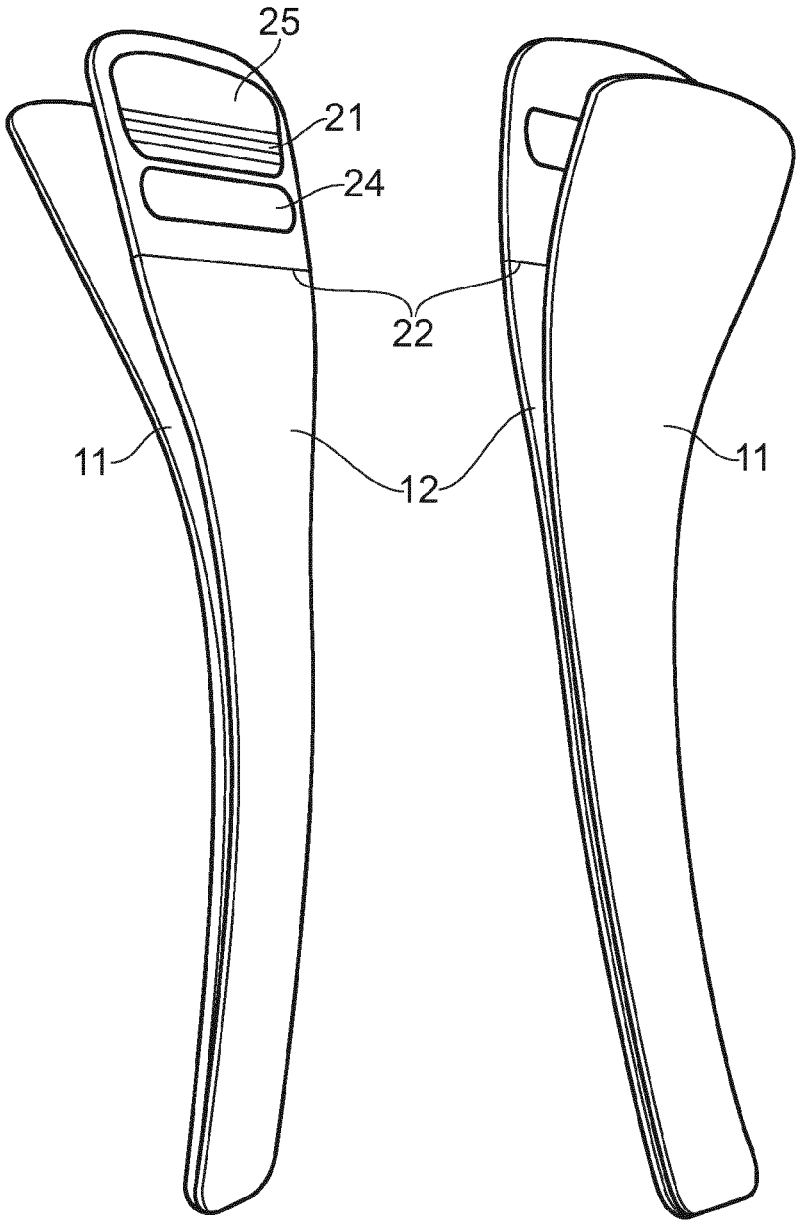

FIGS. 5*a* and 5*d* show a razor 1 from above, and FIGS. 5*b* and 5*c* show it from below. The embodiment of FIG. 5 differs from the previously described embodiments substantially in the design of the handle 10, the subregion 34 and the blade head 20.

In the embodiment shown in FIG. 5, the handle 10 is concavely formed. The user can advantageously place his/her index finger on the head end 16 of the upper face 11 and thus exert a slight pressure on the handle 10, and consequently the lower face 12 and the blade head 20 thereof.

The blade head 20 ideally comprises both razor blades 21 and balsam strips 24, 25. The blade head 20 is advantageously arranged detachably by means of a recess 22 on the lower face 12 and can correspondingly be changed.

In the embodiment of FIG. 5, the subregion 34, which makes the deflection of the blade head 20 possible, extends over the entire lower face 12. The entire lower face 12 is therefore produced from a material that is more elastic than the material of the upper face 11.

Figure 6A:
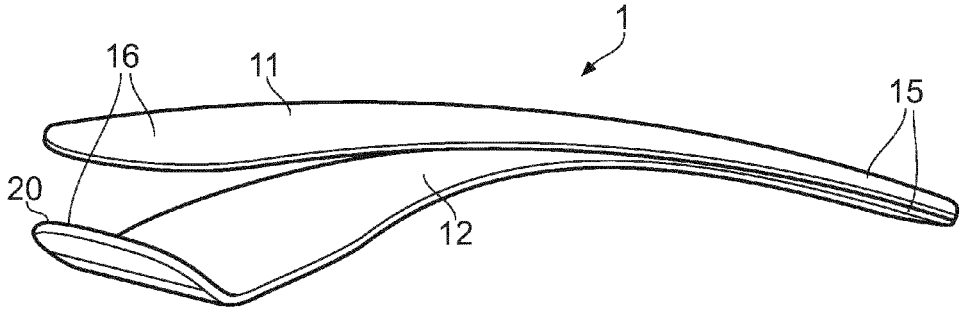
FIGS. 6*a* to 6*d* show a further embodiment of a razor according to the invention.
Figure 6B:
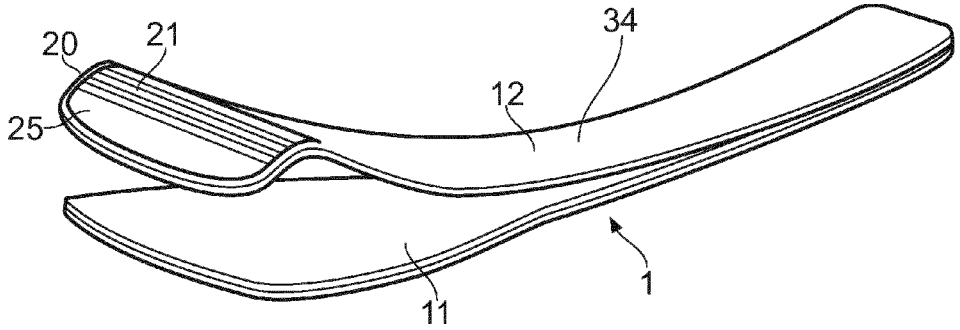
Figures 6C, 6D:
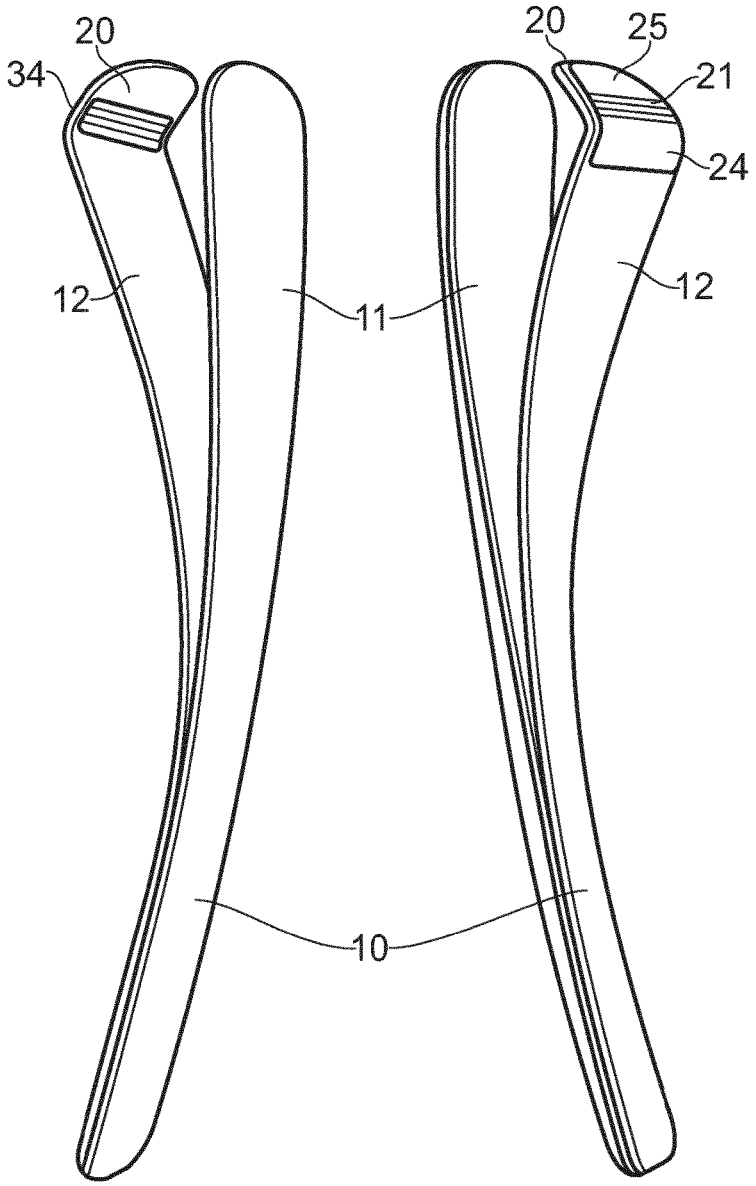

FIGS. 6*a* and 6*c* show a razor 1 from above, and FIGS. 6*b* and 6*d* show it from below.

The embodiment of FIG. 6 differs from the previously described embodiments substantially in the design of the blade head 20 and the head end 16 of the lower face 12. As in FIG. 5, the subregion 34 extends over the entire lower face 12.

The blade head 20 is arranged at an obtuse angle in relation to the lower face 12, i.e. the blade head 20 is inclined in the direction of the upper face 11. The razor blades 21 may be arranged on the outer side of the angle, on the rounding thereof (not represented), which allows them to glide along on the surface of the skin in a particularly prominent manner during shaving. The balsam strip 25 can be placed on the skin and used by tilting the razor 1. Thus, both shaving and skin care can be carried out with a blade head 20. Alternatively or in addition, it is possible that in or at the region of the balsam strip 25 there is arranged a special blade, which can be placed on the skin and used by tilting the razor 1. In FIG. 6*d* it can be seen that a balsam strip 24 is arranged on the outer side of the angle at the rounding thereof.

Figure 7A:
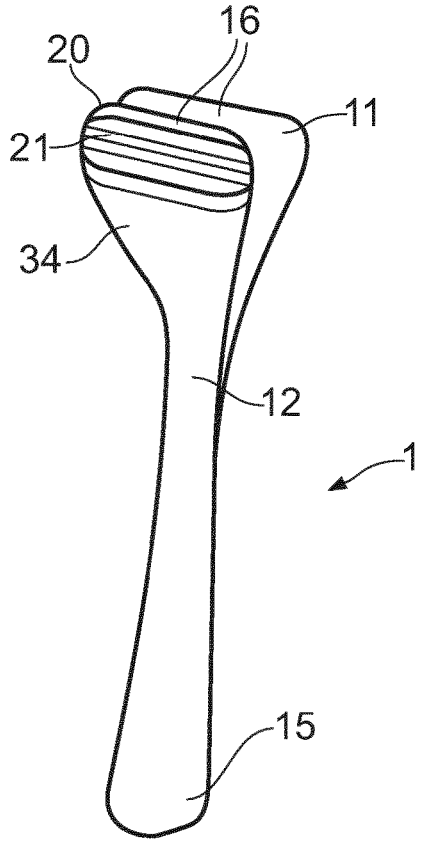
FIGS. 7*a* to 7*d* show a further embodiment of a razor according to the invention.
Figure 7B:
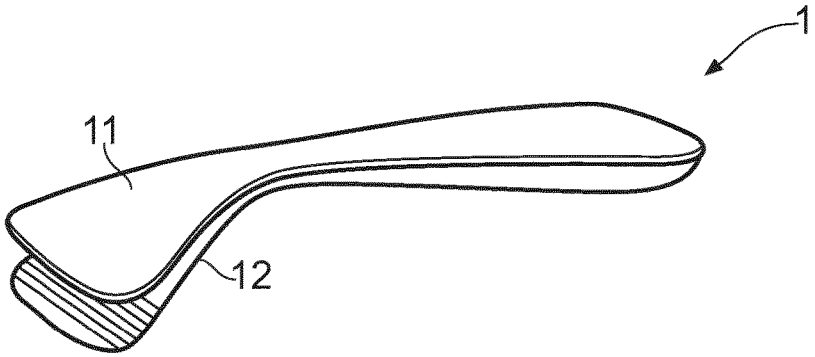
Figure 7C:
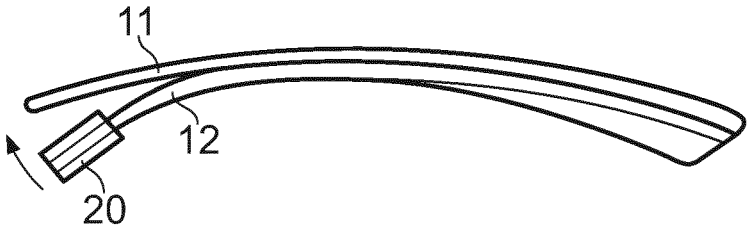
Figure 7D:
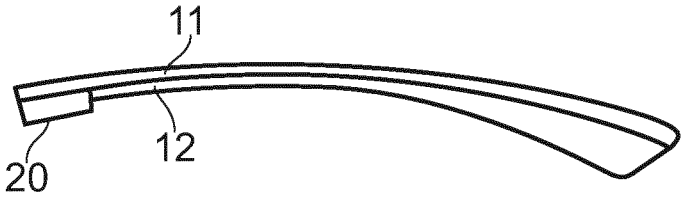

FIG. 7*b* shows a razor 1 from above, and FIG. 7*a* shows it from below. The subregion 34 is provided on the head part 16. FIG. 7*c* shows the razor 1 in the relieved state and FIG. 7*d* shows how the head end 16 of the lower face 12 is deflected under pressure in the direction of the upper face 11.

LIST OF REFERENCE NUMERALS

1 Razor
10 Handle
11 Upper face
12 Lower face
13 Slide ring
15 Handle end
16 Head end
20 Blade head
21 Razor blades
22 Recess
24 Balsam strip
25 Balsam strip
34 Subregion

What is claimed is:

1. A razor, wherein the razor comprises a handle having a lower face for resting on skin of a user and an upper face, opposite from the lower face, for lying in a hand of the user, a blade head comprising at least one razor blade at a head end of the lower face, the lower face and the upper face being fixed to one another at a respective handle end and being designed to be spaced apart from one another at a respective head end, and wherein at least one of: (a) the lower face is more elastic in at least a subregion between the handle end and the head end than an opposite subregion of the upper face, (b) an outline of the lower face corresponds to an outline of the upper face, and (c) the blade head further comprises a balsam strip.

2. The razor of claim 1, wherein the lower face is more elastic in at least a subregion between the handle end and the head end than an opposite subregion of the upper face.

3. The razor of claim 1, wherein the head ends of the lower face and the upper face overlap at least partially.

4. The razor of claim 2, wherein the head ends of the lower face and the upper face overlap at least partially.

5. The razor of claim 1, wherein an outline of the lower face corresponds to an outline of the upper face.

6. The razor of claim 1, wherein the lower face is a leaf spring.

7. The razor of claim 1, wherein along a longitudinal axis of the razor the lower face comprises a multiplicity of subregions with different elasticities.

8. The razor of claim 1, wherein the blade head is arranged at the head end of the lower face as an extension of the lower face.

9. The razor of claim 1, wherein the blade head further comprises a balsam strip.

10. The razor of claim 1, wherein the handle comprises grip elements for nonslip holding of the handle by the user.

11. A method for producing the razor of claim 1, wherein the method comprises:

providing a handle having a lower face for resting on skin of a user and an upper face, opposite from the lower face, for lying in a hand of the user, providing a blade head comprising at least one razor blade on the lower face, and fixing the lower face and the upper face to one another at a respective handle end, a respective head end of the lower face and the upper face being designed to be spaced apart from one another;

and wherein the method further comprises at least one of: (a) providing a lower face which is more elastic in at least a subregion between the handle end and the head end than an opposite subregion of the upper face, (b) providing the lower face with an outline which corresponds to an outline of the upper face, and (c) providing a blade head which further comprises a balsam strip.

12. The razor of claim 2, wherein the upper face and the lower face consist of the same material and only a flexible subregion of the lower face comprises a different, more elastic material.

13. The razor of claim 2, wherein the upper face is formed from a material that is rigid in relation to the material of the lower face.

14. The razor of claim 1, wherein the handle ends of the upper face and the lower face are formed in one piece, and a remaining part of the lower face is fastened movably to the handle end.

* * * * *